US006325663B1

(12) United States Patent
Fukuda

(10) Patent No.: US 6,325,663 B1
(45) Date of Patent: Dec. 4, 2001

(54) HALF-FITTING PREVENTION CONNECTOR

(75) Inventor: Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/650,650

(22) Filed: Aug. 30, 2000

(30) Foreign Application Priority Data

Aug. 30, 1999 (JP) ..... 11-243939

(51) Int. Cl.[7] ..... H01R 3/00
(52) U.S. Cl. ..... 439/489; 439/352
(58) Field of Search ..... 439/489, 352, 439/353, 357, 358

(56) References Cited

U.S. PATENT DOCUMENTS

| | | | | |
|---|---|---|---|---|
| 5,137,466 | | 8/1992 | Endo et al. | 439/357 |
| 5,183,410 | | 2/1993 | Inaba et al. | 439/489 |
| 5,217,385 | * | 6/1993 | Inoue et al. | 439/489 |
| 5,749,747 | | 5/1998 | Inaba et al. | 439/358 |
| 5,820,400 | | 10/1998 | Yamanashi et al. | 439/358 |
| 5,919,056 | | 7/1999 | Suzuki et al. | 439/352 |
| 6,109,956 | * | 8/2000 | Kawase et al. | 439/489 |

FOREIGN PATENT DOCUMENTS

| | | | | |
|---|---|---|---|---|
| 000622870 | * | 11/1994 | (EP) | 439/489 |
| 2 324 029 A | | 10/1998 | (GB) . | |
| 2 342 791 A | | 4/2000 | (GB) . | |
| 55-166881 | | 12/1980 | (JP) . | |
| 4-61873 | | 5/1992 | (JP) . | |
| 4-163870 | | 6/1992 | (JP) . | |
| 4-306575 | | 10/1992 | (JP) . | |
| 9-180818 | | 7/1997 | (JP) . | |
| 9-180820 | | 7/1997 | (JP) . | |
| 9-185974 | | 7/1997 | (JP) . | |

* cited by examiner

*Primary Examiner*—Tho D. Ta
(74) *Attorney, Agent, or Firm*—Sughrue Mion, PLLC

(57) ABSTRACT

In a half-fitting prevention connector (1), an elastically-deformable lock arm (9), having a retaining projection (13) at one end thereof, is formed on one end portion of a housing (4) of a first connector (2). A slider (31) is received within the housing (2), and can produce a repelling force by its own resiliency so as to prevent a half-fitted condition. An engagement portion (24) is provided at one end of a housing (16) of a second connector (3), and serves to retain the retaining projection (13) of the lock arm (9). An abutment projection (23) is formed on the one end of the housing (16), and can abut against an abutment portion (34) formed on the slider (31). Thus, the lock arm (9), serving to lock the first and second connectors (2, 3) to each other, and the slider (31), serving to prevent a half-fitted condition, are separate from each other, and therefore even if the slider (31) is damaged, the retaining of the two connectors relative to each other can be positively effected.

3 Claims, 10 Drawing Sheets

HALF-FITTING PREVENTION CONNECTOR

BACKGROUND OF THE INVENTION

1. Field of the Invention

The present invention relates to a half-fitting prevention connector which is extensively used to connect wire ends of a wire harness in an automobile, and is capable of detecting a half-fitted condition. More particularly, the present invention relates to a half-fitting prevention connector having a resilient member for producing a repelling force in one connector in a half-fitted condition.

The present application is based on Japanese Patent Application No. Hei. 11-243939, which is incorporated herein by reference.

2. Description of the Related Art

Recently, various electronic equipment has been mounted on various types of automobiles, and various connectors have been extensively used to provide a connection between such electronic equipment and a connection between wire harnesses. IN a production process and at the time of maintenance, the two connectors are fitted together so as to be electrically connected together. At this time, unless the two connectors are completely fitted together, the electrical connection between the two is incomplete. Therefore, there has been proposed a half-fitting prevention connector having the function of pushing two connectors, fitted together in a half-fitted condition, away from each other, and when the two connectors are completely fitted together, the two connectors are retained relative to each other, thereby preventing the two connectors from being easily disengaged from each other.

One such conventional half-fitting prevention connector will now be described with reference to FIGS. 11 and 12. This connector is of such a construction that a female connector (one connector) 51 and a male connector (the other connector) 52, when fitted together, are prevented from being kept in a half-fitted condition.

The female connector 51 includes a housing 53, a connection portion 61 for connection to the mating male connector 52, and retaining means 71 for retaining the connector when the two connectors are connected together, the connection portion 61 and the retaining means 71 being provided within the housing 53. A half-fitting prevention function is provided at the retaining means 71.

The connection portion 61 is provided at a lower side of a partition wall 54 dividing the interior of the housing 53 into an upper and a lower section. Female terminals 64 are inserted respectively in terminal receiving chambers 63, formed by partition walls 62, against withdrawal. Each female terminal 64 is retained by one end of the partition wall 62 against withdrawal, and one end of the female terminal 64 communicates with an insertion hole 62*a* through which a male terminal 83 in the male connector 52 can be passed, and a wire 56 is connected to the other end of the female terminal 64.

The retaining means 71 comprises a lock member 72, which is pivotally movable about an axis on the housing 53, and is movable in a longitudinal direction of the housing 53, and a spring 73 which normally urges this lock member 72 in a direction of arrow A.

The mating male connector 52 includes an insertion frame 82 which projects from a base plate 81 so as to be fitted into the female connector 51, and the connection terminals 83 are inserted in the male connector 52 against withdrawal. A retaining projection 84 for retaining engagement with a retaining portion 75 is formed on an upper surface of the insertion frame 82 disposed above the connection terminals 83. In accordance with the connector-fitting operation, this retaining projection 84 pushes the lock member 72 against the bias (resilient force) of the spring 73, so that a half-fitted condition is detected.

Next, the fitting operation of the female and male connectors 51 and 52 will be described.

First, when the insertion frame 82 of the male connector 52 is inserted into gaps G1 and G2 in the female connector 51, the retaining projection 84, formed on the male connector 52, is brought into abutting engagement with the retaining portion 75 formed at the distal end of the lock member 72. Then, when the female connector 51 is further pushed, the whole of the lock member 72 is moved rearward against the bias of the spring 73, so that the front end of the housing 53 comes closer to the base plate 81 of the male connector 52.

However, the retaining portion 75 is not retained by the retaining projection 84, and therefore if the pushing force ceases to be applied to the female connector 51, the female connector 51 is withdrawn in a disengaging direction, so that the half-fitted connection is prevented.

Then, when the female connector 51 is further pushed, the whole of the lock member 72 is moved toward the rear end of this connector, so that a lock cancellation projection 76, formed on the lock member 72, slides over a lock cancellation projection 78 formed on the housing 53. Namely, the distal end portion of the lock member 72 is forcibly lifted, and the whole of the lock member 72 is pivotally moved about support projections 77, so that the lock member 72 is pushed by the resilient force of the spring 73 in the direction of arrow A (see FIG. 11).

When the whole of the lock member 72 is thus pushed in the direction of arrow A, the retaining portion 75 slides over the retaining projection 84, and is retained by this retaining projection 84, so that the female connector 51 is fitted on the male connector 52 against withdrawal.

Therefore, when the female connector 51 is disposed in a half-fitted condition relative to the male connector 52, the lock member 72 is not pivotally moved, and is pushed away from the male connector 51 by the resilient force of the spring 73.

In the above conventional half-fitting prevention connector, however, the lock member 72 has the half-fitting prevention function and the retaining function which are performed when fitting the female connector 51 on the male connector 52. Therefore, for example, if the lock member 72 should be damaged, the half-fitting prevention function and the retaining function are both lost. In such a case, whether or not a half-fitted condition is encountered can not be judged, and there has been a possibility that the female connector 51 is withdrawn after it is connected to the male connector.

And besides, the lock member 72, having the retaining portion 75, is combined with the spring 73, and therefore it is rather cumbersome to mount the lock member on the housing 53, which has invited a problem that the productivity is not high.

SUMMARY OF THE INVENTION

The present invention has been made in view of the above problems, and an object of the present invention is to provide a half-fitting prevention connector in which a half-fitted condition can be positively detected when male and female connectors are fitted together, and a half-fitting prevention function and a retaining function are performed by separate members, respectively.

To achieve the above object, according to the first aspect of the present invention, there is provided a half-fitting prevention connector which comprises a first connector including a housing, a second connector fittable to the first connector, the second connector including a housing, a lock arm formed on one end portion of the housing of the first connector so as to be elastically deformable, the lock arm having a retaining projection formed at an end thereof, a slider insertable into the housing of the first connector, the slider which is able to be extended and contracted due to its own resiliency while guided by part of the lock arm, an abutment portion formed at an end of the slider, an engagement portion provided on one end portion of the housing of the second connector, and serving to retain the retaining projection when the second connector is fitted to the first connector, and an abutment projection formed on the one end portion of the housing of the second connector, wherein during fitting of the second connector to the first connector, the abutment projection abuts against the abutment portion of the slider so as to produce a repelling force between the two housings by resiliency of the slider.

In the half-fitting prevention connector of the above construction, during the time that the first and second connectors are fitted together, the abutment portion of the slider, received in the housing of the first connector, abuts against the abutment projection formed on the housing of the second connector. At this time, the slider is contracted due to its own resiliency, and therefore the resilient force (repelling force) is produced, with the abutment projection serving as a support point, thereby returning the first connector, so that a half-fitted condition can be positively detected.

Then, when the fitting operation is continued, so that the two connectors are fitted into a proper position relative to each other, the retaining projection on the lock arm, formed at the one end portion of the housing of the first connector, is retained by one end of the engagement portion on the second connector, so that the first and second connectors are completely fitted together.

According to the second aspect of the present invention, it is preferable that the slider includes a spring portion which is able to be extended and contracted, a guide frame portion generally embracing a guide portion of the lock arm while sliding along the guide portion, and the abutment portion for abutting engagement with the abutment projection, wherein the spring portion, the guide frame portion and the abutment portion are formed integrally with one another. Accordingly, when the abutment portion abuts against the abutment projection on the second connector during the connector-fitting operation, the spring portion is compressed, so that a repelling force is produced between the first and second connectors. Therefore, when the fitting operation is stopped, the first and second connectors are withdrawn or disengaged from each other by the resilient force (repelling force) of the spring portion, so that this half-fitted condition can be detected.

DETAILED DESCRIPTION OF THE PREFERRED EMBODIMENT

One preferred embodiment of a half-fitting prevention connector of the present invention will now be described in detail with reference to FIGS. 1 to 10.

Figure 1:
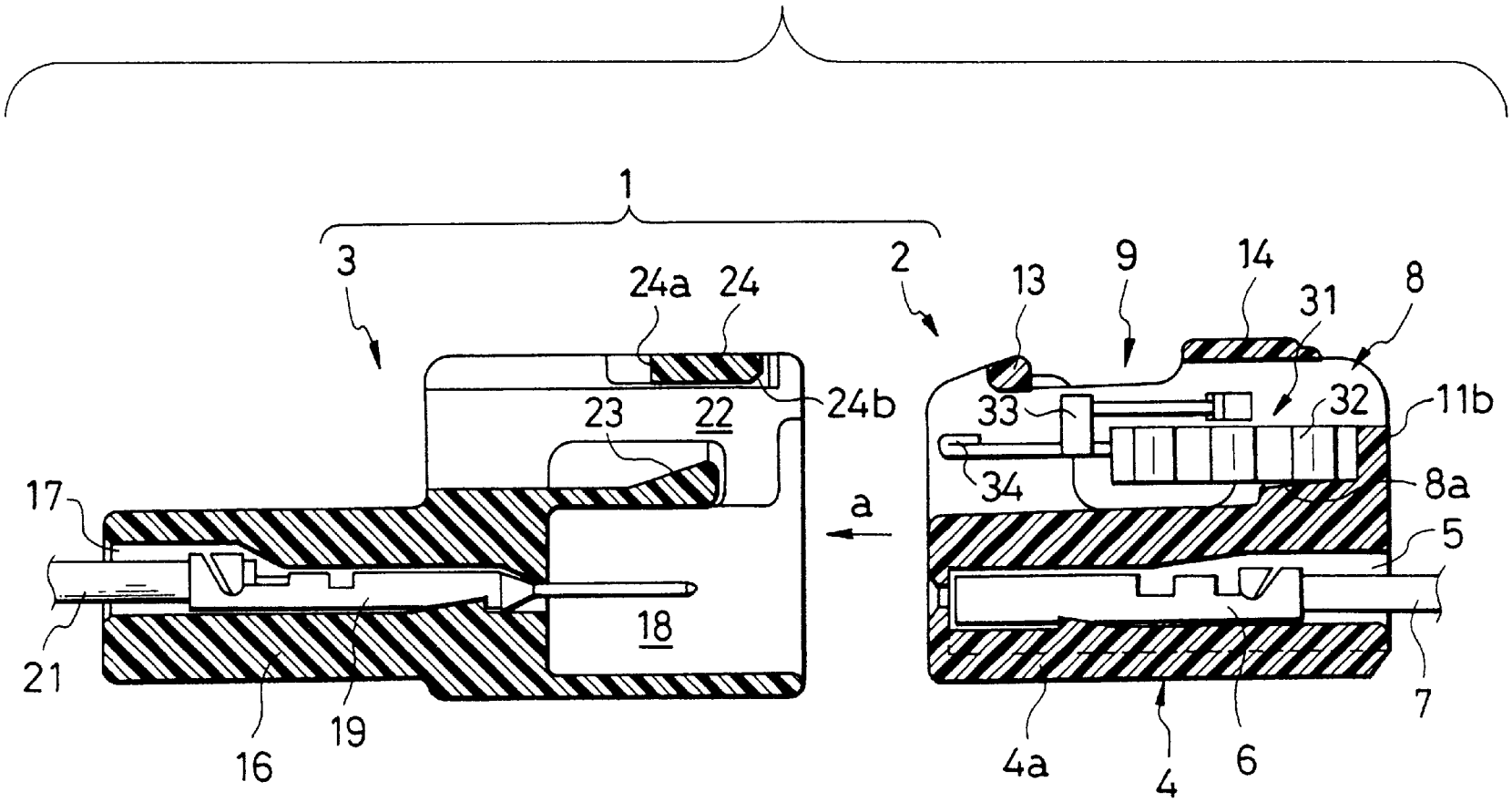
FIG. 1 is a cross-sectional view of one preferred embodiment of a half-fitting prevention connector of the present invention.

In the half-fitting prevention connector 1 of this embodiment shown in FIG. 1, the first connector 2 and the second connector 3 are positively completely fitted together while preventing the two connectors from being kept in a half-fitted condition In the first connector 2, a fitting portion 4*a* is formed at a lower portion of the housing 4, and terminal receiving chambers 5 are formed in this fitting portion 4*a*. Connection terminals 6 of the female type, each press-connected to an end of a wire 7, are received in the terminal receiving chambers 5, respectively. A slider receiving portion 8 is formed at an upper portion of the housing 4, and the slider 31 for preventing a half-fitted connection is received in this slider receiving portion 8. A lock arm 9, having a retaining projection 13 formed at a distal end thereof, is provided at an upper side of the slider receiving portion 8.

Figure 2:
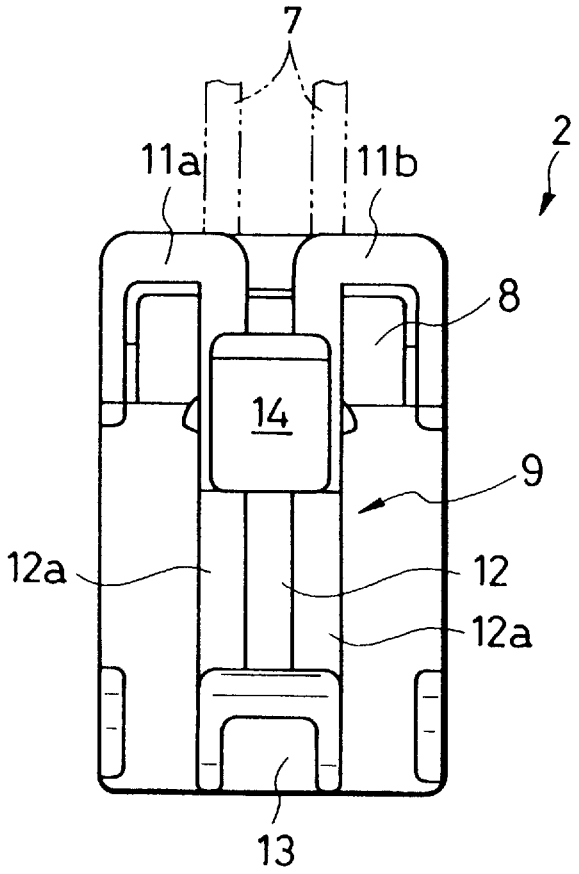
FIG. 2 is a plan view showing the construction of a first connector in FIG. 1.
Figure 3:
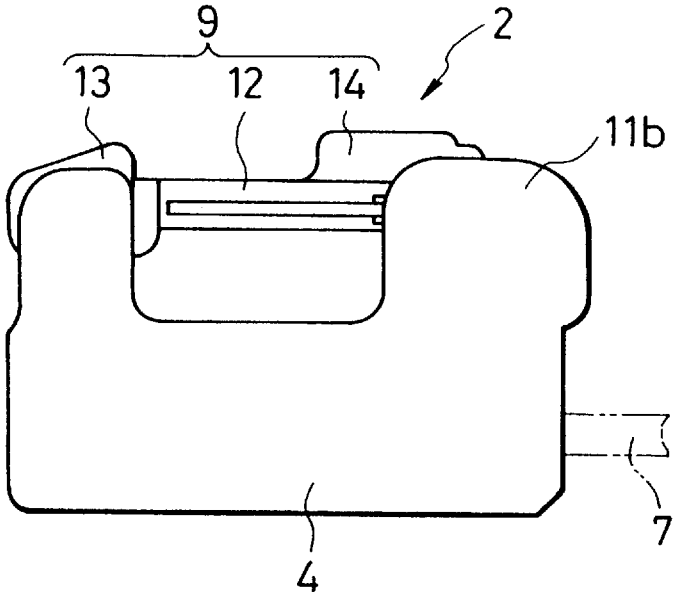
FIG. 3 is a side-elevational view showing the construction of the first connector in FIG. 1.

As shown in FIGS. 2 and 3, the housing 4 has U-shaped frame portions 11*a* and 11*b* formed at a rear end portion thereof, and inner portions of the two frame portions 11*a* and 11*b* extend forwardly to form the lock arm 9. This lock arm 9 includes a plate-like elastic portion 12, the retaining projection 13 formed at a distal end of the elastic portion 12, and a projected operating portion 14 formed on an upper surface of the elastic portion 14 at a rear end portion thereof. The retaining projection 13 is releasably engaged with a rear end 24*a* of an engagement portion 24 (described later) of the second connector 3 when the first and second connectors 2 and 3 are fitted together. In a fitted condition of the connectors, the operating portion 14 is pressed down to elastically deform or flex the lock arm 9.

A flexure space, having an open rear end, and the slider receiving portion 8 are formed at a region which is delimited by the frame portions 11*a* and 11*b*, and is disposed below the elastic portion 12. The elastic portion 12 imparts a resilient force to the retaining projection 13, and also serves to hold and guide the slider 31.

As shown in FIG. 1, the second connector 3 includes the housing 16, and terminal receiving chambers 17 are formed in a rear portion of this housing 16. A tubular fitting hole portion 18 is formed at a front portion of the housing 16, and the first connector 2, that is, the fitting portion 4*a* can be fitted or inserted into this fitting hole portion 18. Connection terminals 19 of the male type, each press-connected to an end of a wire 21, are received in the terminal receiving chambers 17, respectively.

An insertion portion 22 is formed at an upper portion of the housing 16, and when the first connector 2 and the second connector 3 are fitted together, the lock arm 9 and the slider 31, provided at the first connector 2, are inserted into this insertion portion 22. An abutment projection 23 of a generally triangular cross-section is formed within the insertion portion 22, and when the first and second connectors 2 and 3 are fitted together, this abutment projection 23 abuts against the slider 31 on the first connector 2 to push the slider rearward.

Figure 4:
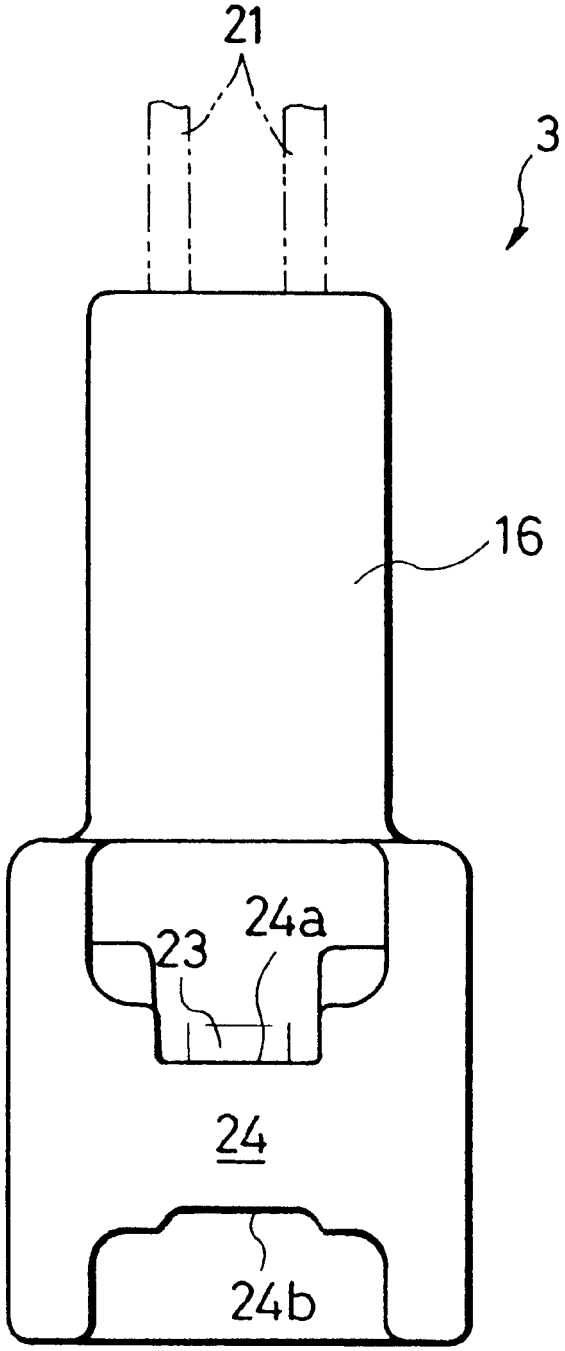
FIG. 4 is a plan view showing the construction of a second connector in FIG. 1.

As shown in FIGS. 1 and 4, the insertion portion 22 is covered with the engagement portion 24, and the retaining projection 13 on the first connector 2 can be retainingly engaged with the rear end 24*a* of this engagement portion 24. A slanting surface 24*b* for smoothly introducing the retaining projection 13 is formed on a lower surface of the engagement portion 24 at a front end thereof.

Figure 5:
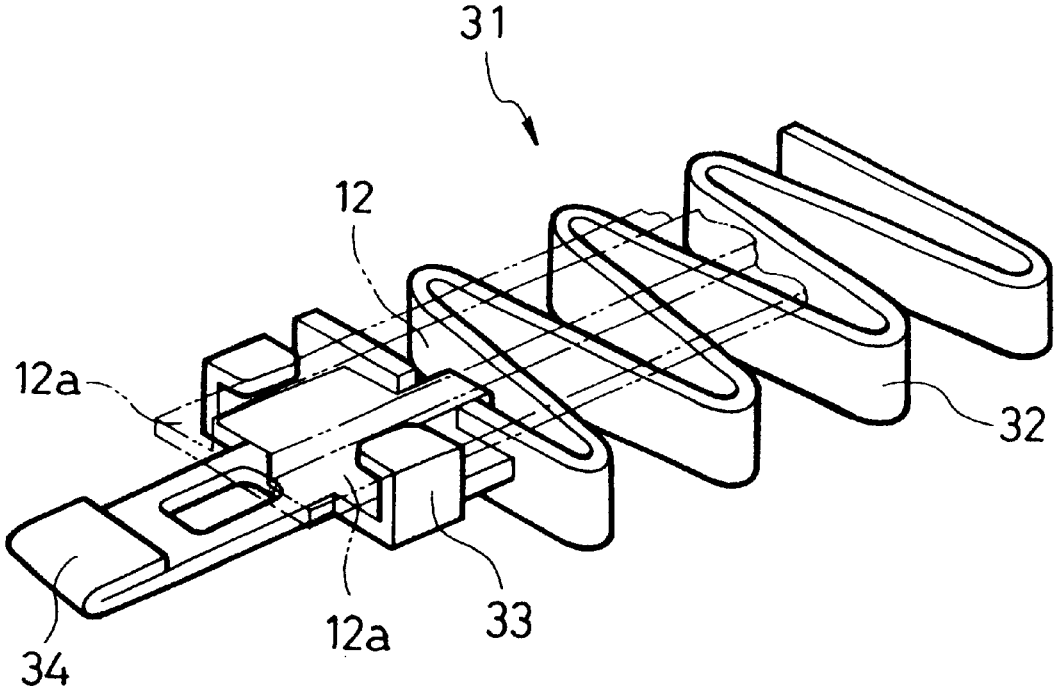
FIG. 5 is a perspective view showing the construction of a slider in FIG. 1.
Figure 6:
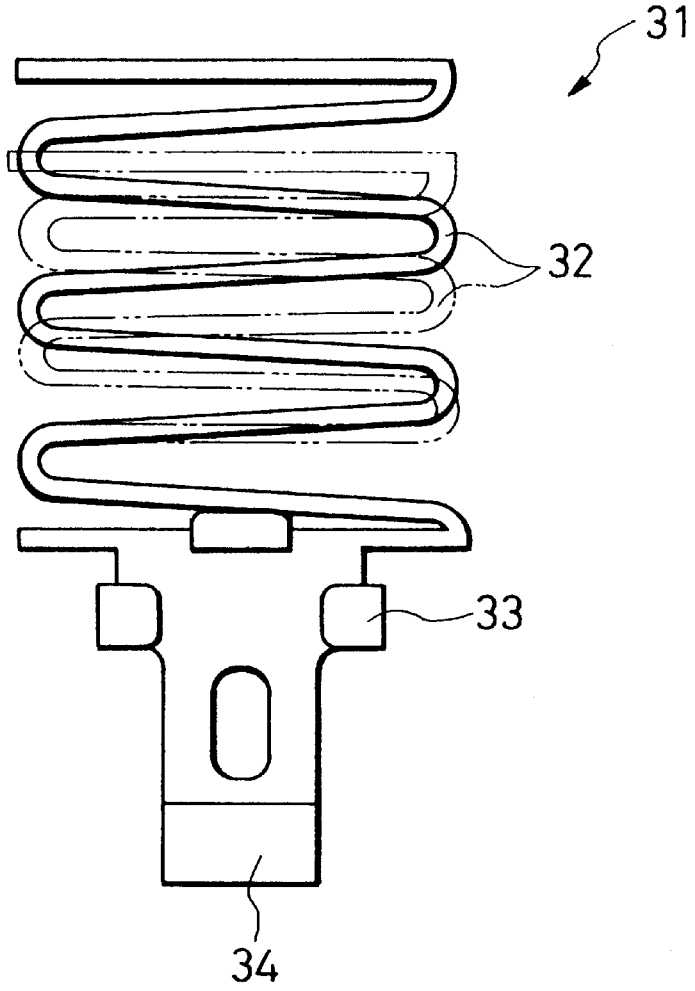
FIG. 6 is a plan view showing the construction of the slider of FIG. 5.
Figure 7:
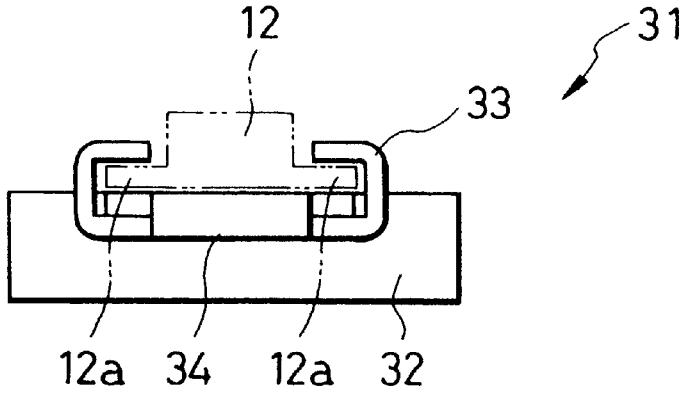
FIG. 7 is a front-elevational view showing the construction of the slider of FIG. 5.

As shown in FIGS. 5 to 7, the slider 31 includes a spring portion 32 bent into a meandering manner, a guide frame portion 33 movably held on the elastic portion 12 of the lock arm 9, and an abutment portion 34 formed at a distal end thereof so as to abut against the abutment projection 23 on the second connector 3. The slider 31 has an integral construction, and is formed of metal such as stainless steel.

The spring portion 32 can be deformed from an extended condition (indicated in a solid line in FIG. 6) into a compressed (or contracted) condition indicated in phantom, and this spring portion 32 is resiliently restored into its original extended condition. The spring portion 32 has such a width as to be fitted in the slider receiving portion 8.

The guide frame portion 33 is formed into an upwardly-open frame-like shape as shown in FIG. 7, and opposite side portions of this guide frame portion 33 embrace guide portions 12*a*, formed respectively on opposite side edges of the elastic portion 12, respectively. Therefore, the slider 31 is mounted in the slider receiving portion 8 in the first connector 2 in such a manner that the guide portions 12*a* are passed through the guide frame portion 33 as indicated in phantom.

A rear end portion (an upper portion in FIG. 6) of the spring portion 32 is held against the inner surfaces of the frame portions 11*a* and 11*b*, and the spring portion 32 is extended and contracted, with these inner surfaces serving as a support point. Namely, when the first and second connectors 2 and 3 are fitted together, the abutment portion 34 is pressed by the abutment projection 23, so that the spring portion 32 is compressed, and the slider 31 is smoothly contracted and expanded along the guide portions 12*a*, that is, in the longitudinal direction of the elastic portion 12.

Next, the operation for fitting the first and second connectors 2 and 3 together will be described.

First, in order to mount the slider 31 in the slider receiving portion 8 in the first connector 2, the guide frame portion 33 of the slider 31 is fitted on the guide portions 12*a* as described above, and the female terminals 6 are inserted into the terminal receiving chambers 5, respectively. The male terminals 19 are inserted respectively into the terminal receiving chambers 17 in the second connector 3.

Then, the first and second connectors 2 and 3 are arranged in opposed relation to each other as shown in FIG. 1, and then the first connector 2 is fitted into the second connector 3 in a direction of arrow a.

Figure 8:
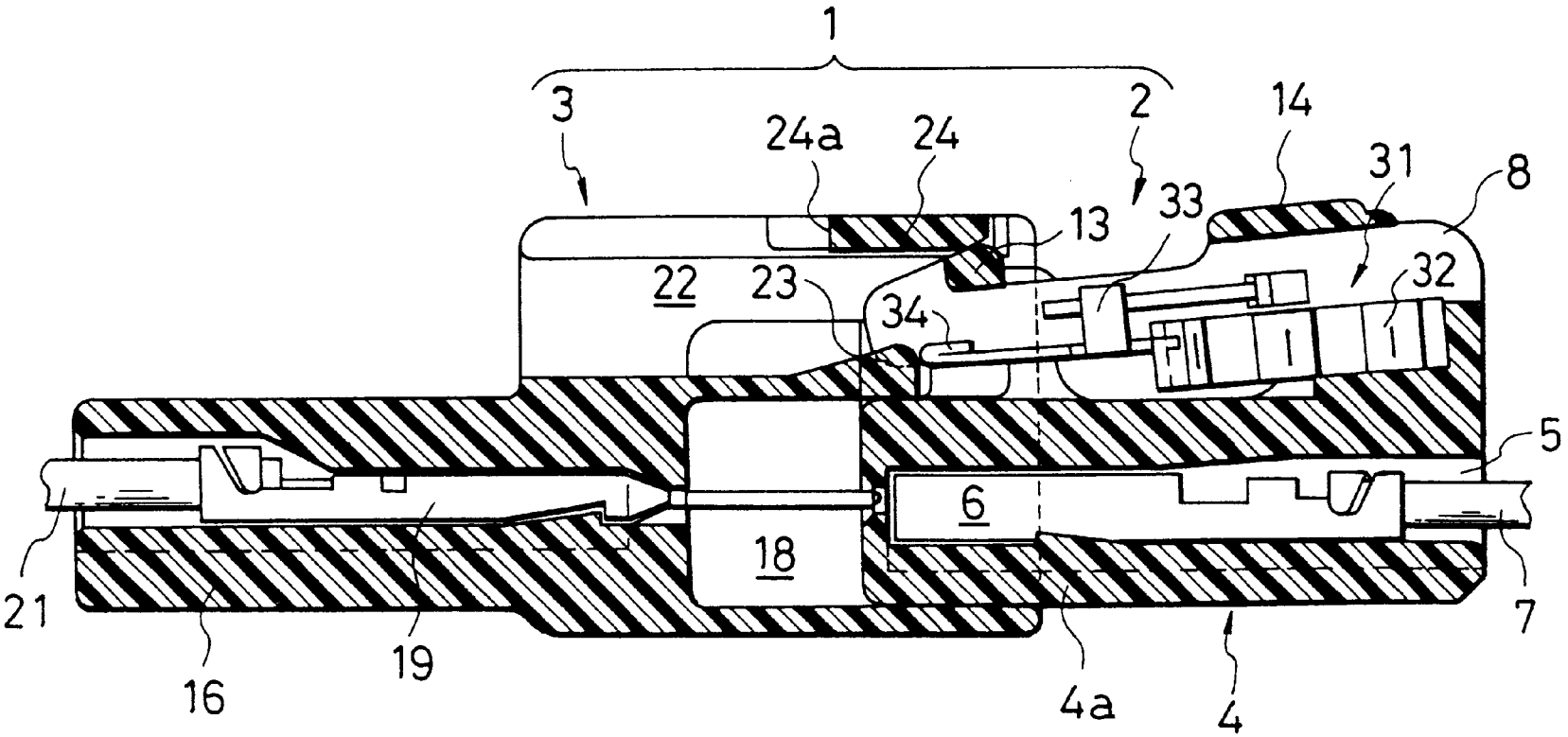
FIG. 8 is a cross-sectional view showing a condition in which the first and second connectors begin to be fitted together.

As a result, the fitting portion 4*a* of the first connector 2 is fitted into the fitting hole portion 18 in the second connector 3, and the retaining projection 13 of the lock arm 9 abuts against the front end of the engagement portion 24, as shown in FIG. 8. Then, when the first connector 2 is further pushed or inserted, the whole of the lock arm 9 is elastically deformed in a forwardly downwardly-slanting manner, and the retaining projection 13 smoothly slides to the lower side of the engagement portion 24 since the slanting surface 24*b* is formed on the lower surface of the engagement portion 24 at the front end thereof. At this time, the whole of the slider 31 is inclined in accordance with the inclination of the lock arm 9 since a forwardly downwardly-slanting surface 8*a* (see FIG. 1) is formed on the lower surface of the slider receiving portion 8.

Figure 9:
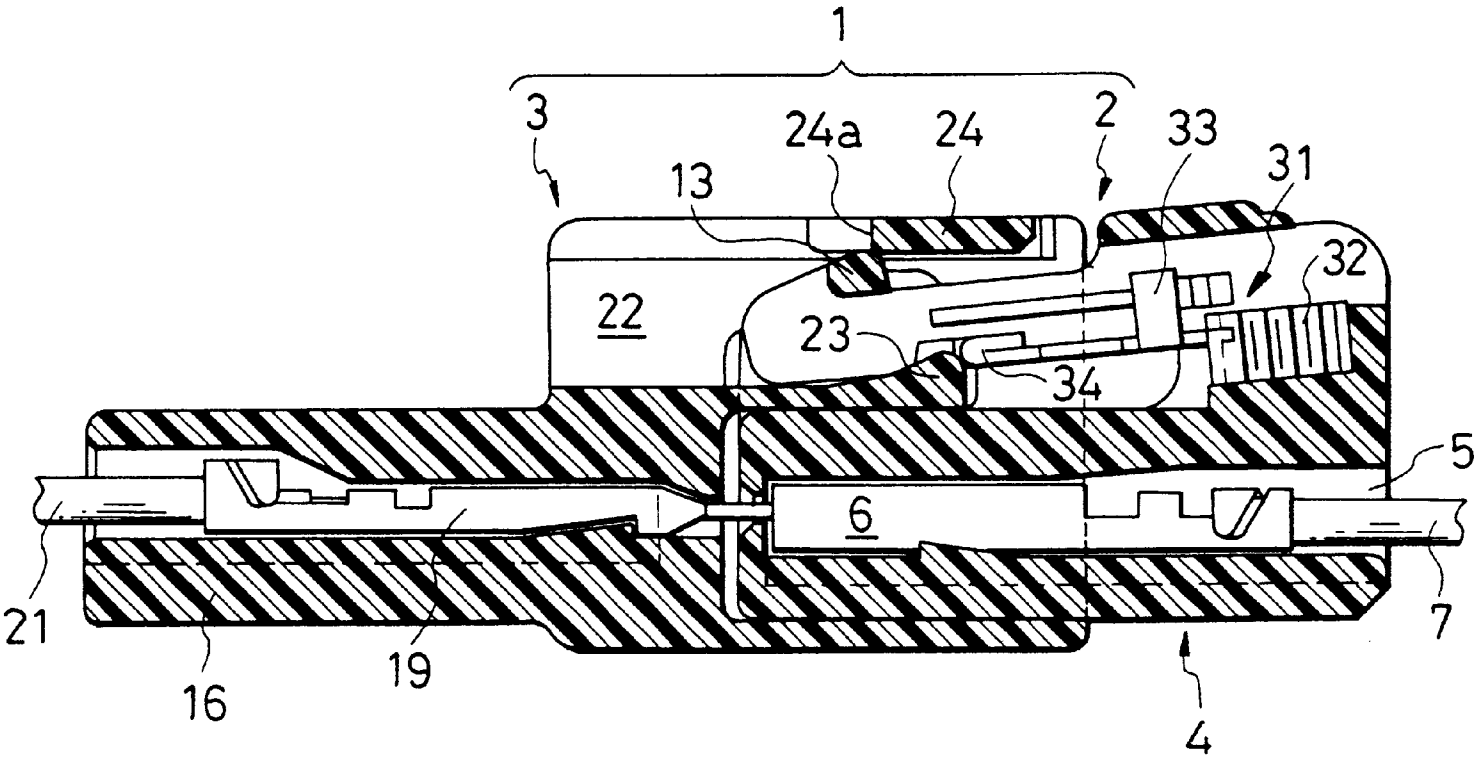
FIG. 9 is a cross-sectional view showing a condition in which the two connectors of FIG. 8 are in a half-fitted condition.

Then, when the first connector 2 is further pushed or inserted into the second connector 3 as shown in FIG. 9, the abutment portion 34 at the distal end of the slider 31 abuts against the abutment projection 23 on the second connector 3.

Then, when the first connector 2 further continues to be inserted, the spring portion 32 of the slider 31 is compressed, so that a disengaging force, tending to return the first connector 2, is produced, with the abutment projection 23 serving as a support point. Therefore, if the pushing operation is stopped, erroneously judging that the fitting connection has been completed, the first connector 2 is withdrawn from the second connector 3 by the resilient force of the spring portion 32, so that this half-fitted condition can be recognized.

Figure 10:
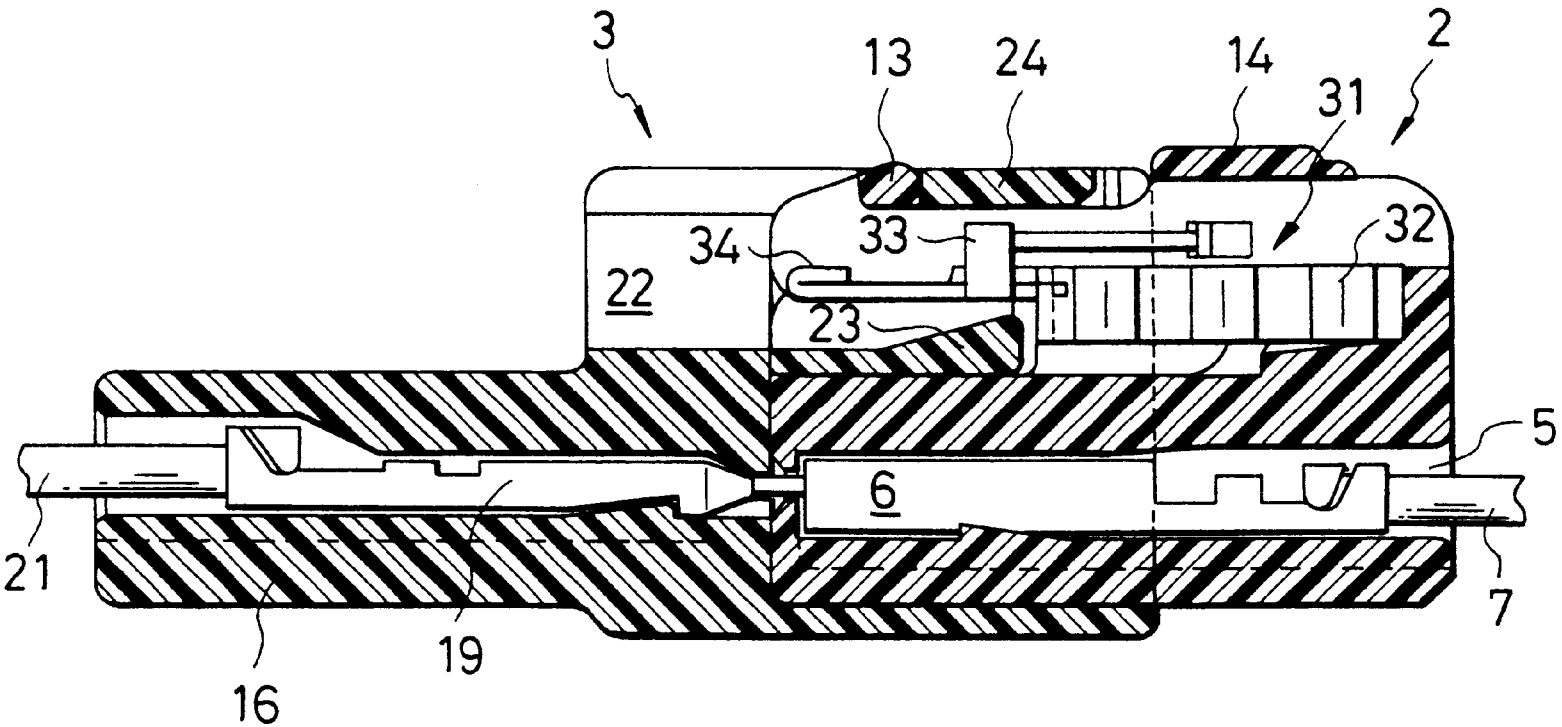
FIG. 10 is a cross-sectional view showing a condition in which the connectors of FIG. 9 are completely fitted together.
Figure 11:
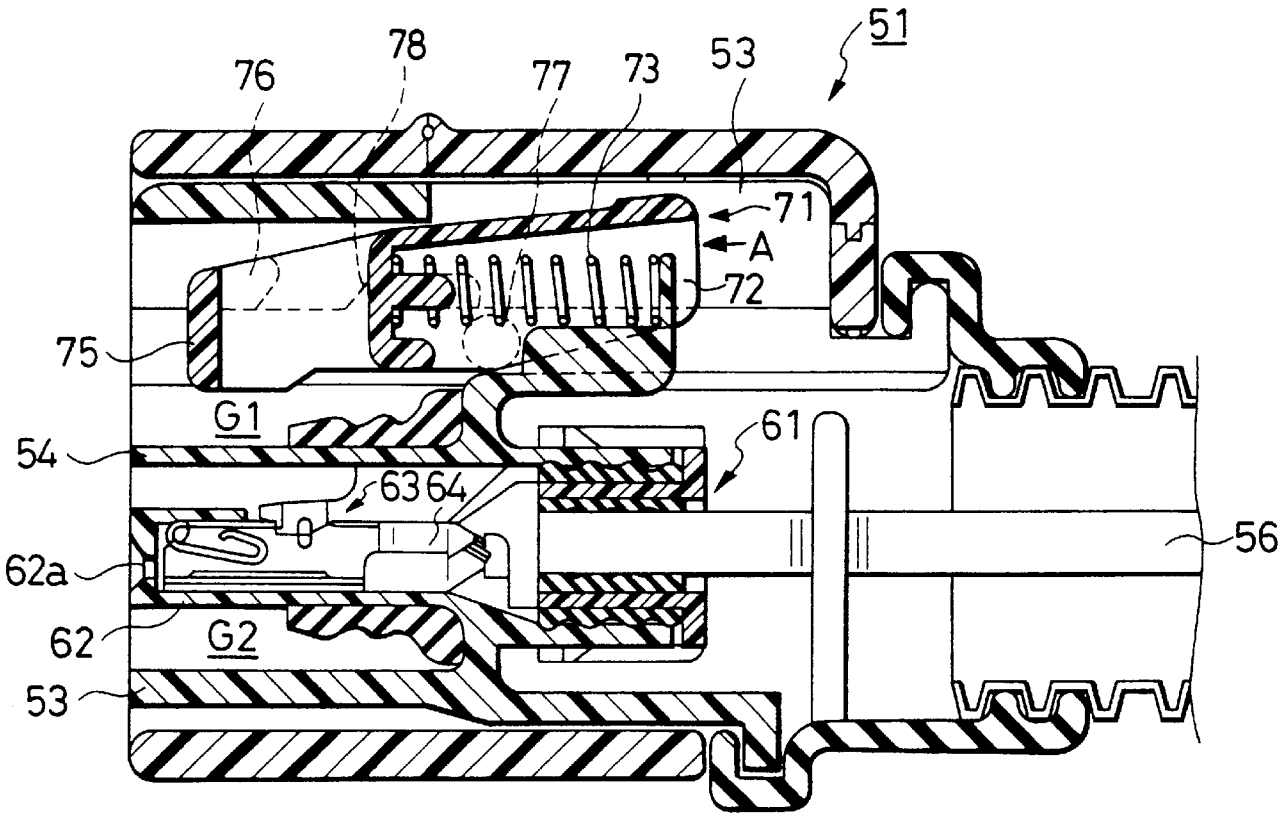
FIG. 11 PRIOR ART
FIG. 11 is a cross-sectional view of a conventional connector.
Figure 12:
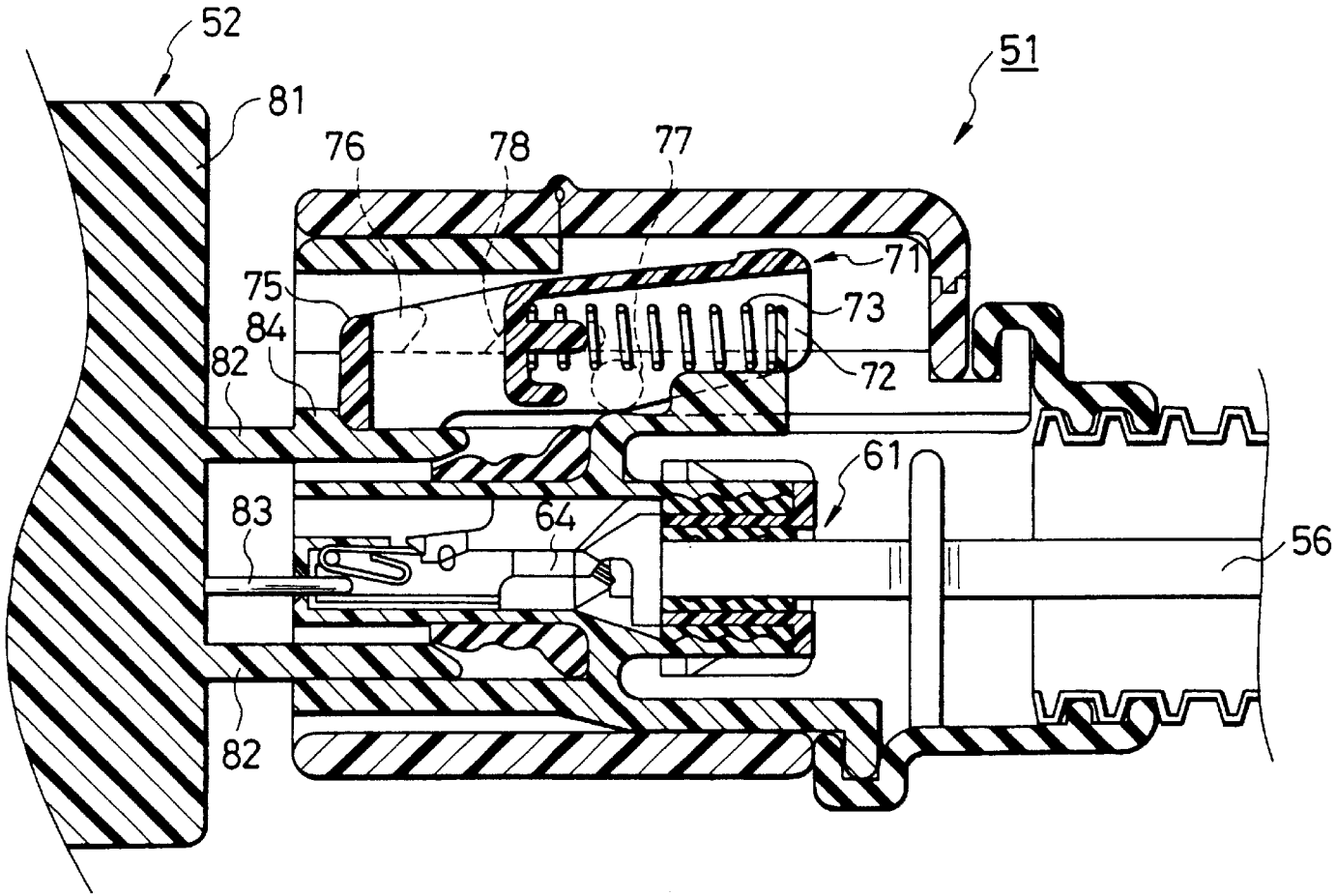
FIG. 12 PRIOR ART
FIG. 12 is a cross-sectional view showing a fitted condition of the connector of FIG. 11.

Then, when the first connector 2 further continues to be inserted into the second connector 3 as shown in FIG. 10, the retaining projection 13 slides on the lower side of the engagement portion 24, and is retainingly engaged with the rear end 24*a* of this engagement portion. At this time, the abutment portion 34 of the slider 31 is disengaged upwardly from the abutment projection 23 in accordance with the restoration of the lock arm 9 into a horizontal condition.

Therefore, the whole of the slider 31 is moved from the inclined condition into a horizontal condition, and at the same time the slider 31 is restored into the original shape by the resilient force of the compressed spring portion 32. Thus, the first connector 2 and the second connector 3 are completely fitted together, and the female terminals 6 are electrically connected to the male terminals 19, respectively.

As described above, in the half-fitting prevention connector 1 of this embodiment, the slider 31, which is the separate member, has only the half-fitting prevention function, and the mutually-fitted condition of the two connectors is locked by the retaining projection 13 of the lock arm 9 and the rear end 24*a* of the engagement portion 24.

Therefore, even if the slider 31 is damaged, the lock arm 9 properly functions to positively keep the two connectors in the mutually-fitted condition.

Therefore, there can be obtained the half-fitting prevention connector of high reliability in which a half-fitted condition can be positively detected during the assembling of an automobile or others and at the time of maintenance, and the disengagement of the two connectors from each other due to a failure of the retaining function can be prevented even when the connector is used in severe environments.

As described above, the half-fitting prevention connector of the present invention comprises the lock arm, which is formed on the one end portion of the housing of the first connector so as to be elastically deformed, and has the retaining projection formed at the end thereof, the slider which is received within the housing, and can be extended and contracted because of its own resiliency while guided by part of the lock arm, the engagement portion which is provided at one end of the housing of the second connector, and serves to retain the retaining projection when the second connector is fitted on the first connector, and the abutment projection formed on the one end of the housing of the second connector, and during the fitting of the second connector on the first connector, the abutment projection abuts against the abutment portion, formed at the end of the slider, so as to cause the slider to produce a repelling force.

During the time when the first and second connectors are fitted together, the slider abuts against the abutment projection on the second connector to produce a repelling force, so that a half-fitted condition can be positively detected. When the two connectors are fitted into the proper position relative to each other, the retaining projection on the lock arm on the first connector, is retained by the one end of the engagement portion on the second connector, so that the first and second connectors are completely fitted together. The lock arm, serving to lock the first and second connectors to each other, and the slider, serving to prevent a half-fitted condition, are separate from each other, and therefore even if the slider is damaged, the retaining of the two connectors relative to each other can be positively effected, and therefore there can be obtained the half-fitting prevention connector of high reliability.

In the above half-fitting prevention connector, preferably, the slider includes the spring portion which can be extended and contracted, the guide frame portion generally embracing the guide portion of the lock arm so as to slide along the guide portion, and the abutment portion for abutting engagement with the abutment projection, and the spring portion, the guide frame portion and the abutment portion are formed integrally with one another.

Therefore, when the abutment portion abuts against the abutment projection on the second connector during the connector-fitting operation, the spring portion is compressed, so that a repelling force is produced between the first and second connectors, so that a half-fitted condition can be positively detected. And besides, the slider comprises the member of an integral or unitary construction, and therefore because of this simple construction, the slider can be easily mounted on the connector, and the productivity is enhanced, and the production cost is reduced.

What is claimed is:

1. A half-fitting prevention connector, comprising:

a first connector including a housing;

a second connector fittable to the first connector, the second connector including a housing;

a lock arm formed on one end portion of the housing of the first connector so as to be elastically deformable, the lock arm having a retaining projection formed at an end thereof;

a slider insertable into the housing of the first connector, the slider which is able to be extended and contracted due to its own resiliency while guided by part of the lock arm;

an abutment portion formed at an end of the slider;

an engagement portion provided on one end portion of the housing of the second connector, and serving to retain the retaining projection when the second connector is fitted to the first connector; and an abutment projection formed on the one end portion of the housing of the second connector, wherein during fitting of the second connector to the first connector, the abutment projection abuts against the abutment portion of the slider so as to produce a repelling force between the two housings by resiliency of the slider, and wherein the slider is disposed in a first position before fitting of the second connector to the first connector, the slider is disposed in a second position during fitting of the second connector to the first connector, and the slider is returned to the first position after the second connector is completely fitted to the first connector.

2. A half-fitting prevention connector according to claim 1, wherein the slider includes a spring portion which is able to be extended and contracted, a guide frame portion generally embracing a guide portion of the lock arm while sliding along the guide portion, and the abutment portion for abutting engagement with the abutment projection, and wherein the spring portion, the guide frame portion and the abutment portion are formed integrally with one another.

3. A half-fitting prevention connector, comprising:

a first connector including a housing;

a second connector fittable to the first connector, the second connector including a housing;

a lock arm formed on an outer end portion of the housing of the first connector so as to be elastically deformable, the lock arm having a retaining projection formed at an end thereof;

a slider insertable into the housing of the first connector, the slider which is able to be extended and contracted due to its own resiliency while guided by part of the lock arm;

an abutment portion formed at an end of the slider;

an engagement portion provided on one end portion of the housing of the second connector, and serving to retain the retaining projection when the second connector is fitted to the first connector; and an abutment projection formed on the one end portion of the housing of the second connector, wherein during fitting of the second connector to the first connector, the abutment projection abuts against the abutment portion of the slider so as to produce a repelling force between the two housings by resiliency of the slider, wherein the lock arm is on the outer end portion of the housing of the first connector so as to be disposed above the slider.

* * * * *